US010160196B2

(12) United States Patent
Driller et al.

(10) Patent No.: US 10,160,196 B2
(45) Date of Patent: Dec. 25, 2018

(54) METHOD FOR MANUFACTURING AND REGENERATING A FUNCTIONAL SURFACE OF AN ANILOX SLEEVE OR ANILOX ROLLER FOR A PRINTING MACHINE AND ANILOX SLEEVE OR ANILOX ROLLER WITH SUCH FUNCTIONAL SURFACE

(71) Applicant: TEROLAB SURFACE GROUP SA, Lausanne (CH)

(72) Inventors: Franz-Josef Driller, Borchen (DE); Christopher Wasserman, Ecublens (CH)

(73) Assignee: TeroLab Surface Group SA, Lausanne (CH)

( * ) Notice: Subject to any disclaimer, the term of this patent is extended or adjusted under 35 U.S.C. 154(b) by 221 days.

(21) Appl. No.: 14/903,825

(22) PCT Filed: Jul. 9, 2014

(86) PCT No.: PCT/CH2014/000099

§ 371 (c)(1),
(2) Date: Jan. 11, 2016

(87) PCT Pub. No.: WO2015/003281

PCT Pub. Date: Jan. 15, 2015

(65) Prior Publication Data

US 2016/0159072 A1 Jun. 9, 2016

(30) Foreign Application Priority Data

Jul. 11, 2013 (CH) ..... 1247/13

(51) Int. Cl.

| | |
|---|---|
| ***B41F 13/11*** | (2006.01) |
| ***B41N 7/06*** | (2006.01) |
| ***C23C 4/129*** | (2016.01) |
| *B41F 31/26* | (2006.01) |
| *B41N 1/00* | (2006.01) |
| *B41N 1/12* | (2006.01) |
| *B41N 1/20* | (2006.01) |
| *B41N 3/00* | (2006.01) |
| *B41N 7/00* | (2006.01) |

(52) U.S. Cl.
CPC ..... *B41F 13/11* (2013.01); *B41N 7/06* (2013.01); *C23C 4/129* (2016.01); *B41F 31/26* (2013.01); *B41N 1/006* (2013.01); *B41N 1/12* (2013.01); *B41N 1/20* (2013.01); *B41N 3/003* (2013.01); *B41N 7/00* (2013.01)

(58) Field of Classification Search
CPC ..... Y10T 29/49544; Y10T 29/4956; Y10T 29/49563; Y10T 29/49728; Y10T 29/49726; Y10T 29/49725; Y10T 29/49723; B41F 13/11; B41F 31/26; B41N 7/06; B41N 7/00; B41N 1/20
See application file for complete search history.

(56) References Cited

U.S. PATENT DOCUMENTS

| | | | | | |
|---|---|---|---|---|---|
| 4,986,181 | A * | 1/1991 | Kobayashi | B41N 7/06 | 101/348 |
| 5,221,562 | A * | 6/1993 | Morgan | B41C 1/05 | 219/121.69 |
| 5,316,859 | A * | 5/1994 | Harada | C23C 2/003 | 29/895 |
| 5,328,763 | A * | 7/1994 | Terry | C22C 29/08 | 419/14 |
| 5,582,874 | A | 12/1996 | Hyde | | |
| 5,644,828 | A * | 7/1997 | Sailer | B23C 3/28 | 29/402.06 |
| 5,857,950 | A * | 1/1999 | Hycner | B41N 7/00 | 29/895.32 |
| 5,967,959 | A * | 10/1999 | Niemi | D21F 3/08 | 492/54 |
| 6,699,101 | B2 * | 3/2004 | Annigeri | B23P 6/007 | 29/402.06 |

(Continued)

FOREIGN PATENT DOCUMENTS

| | | | |
|---|---|---|---|
| EP | 0 791 477 | A2 | 8/1997 |
| EP | 1 264 708 | A2 | 12/2002 |
| GB | 2 423 053 | A | 8/2006 |
| WO | 2006/089519 | A1 | 8/2006 |
| WO | 2011/072404 | A1 | 6/2011 |

OTHER PUBLICATIONS

Field Electron Emmision from Surface of Plasma Sprayed and Laser Engraved Al2O3+13TiO2 and Al2O3+40TiO2 Coatings, Znamirowski et al., 2003 pp. 1069-1072.*
Replacement for Hard Chrome Plating in Printing Machinery, Wasserman et al., ASM International, 2001 pp. 69-74.*
316L—an Alternative to NiCr Bondcoats for Cr2O3 Coatings on Anilox Rollers, Winkler et al., 2003 pp. 149-152.*
International Search Report Corresponding to PCT/CH2014/000099 dated Nov. 12, 2014.
Written Opinion Corresponding to PCT/CH2014/000099 dated Nov. 12, 2014.

*Primary Examiner* — Jason L Vaughan
(74) *Attorney, Agent, or Firm* — Davis & Bujold PLLC; Michael J. Bujold

(57) ABSTRACT

A method for manufacturing and regenerating a functional surface of an anilox sleeve or anilox roller for a printing machine with a coating protecting against wear and corrosion. The anilox sleeve is preferably made out of a light-weight plastic on which an intermediate layer is applied and has a metal tube located above the intermediate layer. During a first phase, the worn engraving and the old layer are ground off from the cylindrical surface of the anilox sleeve, that is to say from the metal tube, and a coating, a carbidic tungsten carbide-cobalt-chromium layer (WC—Co—Cr) is subsequently applied. This carbidic layer is applied by a high-speed flame spraying (HVOF) process and subsequently functionalized by laser.

15 Claims, 1 Drawing Sheet

(56) References Cited

U.S. PATENT DOCUMENTS

| | | | | |
|---|---|---|---|---|
| 6,797,331 | B2 | 9/2004 | Singler et al. | |
| 8,497,449 | B1 * | 7/2013 | Budd | B23K 26/06 219/121.69 |
| 9,796,202 | B2 * | 10/2017 | Perrier | B41C 1/05 |
| 2009/0023567 | A1 | 1/2009 | Johner et al. | |
| 2009/0301328 | A1 * | 12/2009 | Zahiri | B41F 13/11 101/375 |
| 2011/0068509 | A1 * | 3/2011 | Perrier | B41C 1/05 264/400 |

* cited by examiner

METHOD FOR MANUFACTURING AND REGENERATING A FUNCTIONAL SURFACE OF AN ANILOX SLEEVE OR ANILOX ROLLER FOR A PRINTING MACHINE AND ANILOX SLEEVE OR ANILOX ROLLER WITH SUCH FUNCTIONAL SURFACE

TECHNICAL SCOPE

The invention relates to a method for manufacturing and regenerating a functional surface of an anilox sleeve or anilox roller for a printing machine.

The invention also relates to a manufactured or regenerated anilox sleeve or anilox roller for a printing machine with such functional surface.

PRIOR ART

The prior art in a printing machine relates to coated rollers or generally so-called "sleeves" that feature a variety of coating materials and types. Ceramic coatings against wear and corrosion are known in particular for media-transferring rollers and cylinders made of metallic materials.

The surfaces used until now for transferring inks using anilox rollers or for transferring the print image using gravure cylinders are coated with a ceramic surface that is subsequently structured with a laser. In addition, gravure cylinders having a metallic surface and being engraved electromechanically by a graver but also by a laser are also known. The materials used hereto are soft metals such as e.g. copper and zinc, which can subsequently be chromium-plated. In addition, the wet chemical etching of a structure exposed by means of a laser is also a common method.

The previous solutions are based on the engravability of the various materials associated with the highest possible wear resistance and an additional corrosion protection against aggressive printing and cleaning media.

This is in particular problematic with thermally coated ceramic materials, since these materials generally have a basic porosity and therefore can spall partially despite high hardness. As a result of open-porousness, liquids can penetrate up to the basic body and lead to undercorrosion.

Soft metallic layers must be protected afterwards against wear by subsequent chromium plating. As in printing operation the quantity transferred by the anilox rollers/sleeves is a decisive criterion, the concerned surfaces are "scraped" by stainless steel blades.

This inevitably leads to high surface wear.

The traditional coating is a thermally-applied chromium oxide ceramic that, due to the current environmental legislation, requires high extraction and filtering efforts during production. The formation of stains during manufacture leads partially to rejects. This is due to grinding water or finishing water that, due to the typical porosity and roughness, penetrates in the surface and becomes visible again in the form of stains only after engraving.

Other disadvantages of the known technology include e.g. soiling by residual ink in the cells, which requires the cleaning of the surfaces with aggressive cleaners and ultrasound. This can result in undercorrosion leading to premature failure.

New modern printing machines use so-called sleeves instead of heavy rollers. These are sleeves composed of different materials. Usually they include a fiberglass inner sleeve, covered by a compressible layer and finally an aluminum tube on which the ceramic is applied by a plasma spraying method. The sleeve is slided onto an air mandrel installed in the printing machine. During this operation, compressed air passes through the mandrel, exits at the surface of the mandrel through corresponding holes in order to let the sleeve glide on an air cushion. Such sleeves are much lighter than rollers and can be installed and removed very quickly thanks to this system. This sleeve system guarantees shortest setup times possible when changing job on the printing machine.

The prior art also includes British Patent GB 2 423 053 which describes an anilox roller made of ceramic or hard metal, cells being formed on its surface with a laser. It defines a method for coating a cylindrical surface of a roller body for a printing machine. It defines a method for coating a cylindrical surface of a roller body for a printing machine.

Even though the anilox roller offers an advantage due to its compact construction, its reconditioning is however time-consuming and cost-intensive.

International Patent Application No. WO 2006/089519 is part of the prior art; it describes a coated body, in particular a roller out of carbon fiber-reinforced plastic. The body has an adhesion layer made of ductile metal optionally out of copper, nickel, iron, lead or tin applied by plasma spraying. Here too, the compact construction is appealing, but the disadvantages related to costs and reconditioning exist also here.

Also European application EP 1 264 708 A2 belongs to the prior art; it describes an anilox roller with the following structure: inner body that rotates on an axis and has an extensible outer layer, compressible intermediate layer out of plastic and a carrier tube I. This roller has a cylindrical surface with a WC—Co layer. Here too, even though body construction has been the subject of further development, reconditioning the surface entails high costs and involves an enormous time factor.

DESCRIPTION OF THE INVENTION

The present invention aims to reduce significantly the described negative characteristics of the previous technologies. The new coating is easy to apply and shows excellent wear and corrosion protection, Therefore, the inventive method is characterized in that a coating protecting against wear and corrosion is applied by high-speed flame spraying (HVOF) on the cylindrical surface of the anilox sleeve or anilox roller, wherein the coating material is a cermet made of a mixture of a hard phase and a metallic binder, and in that the surface topography of the coating is structured by local volatilization of coating material under the action of an ytterbium fiber laser in such a way that the use of the anilox sleeve or anilox roller allows supplying a defined an reproducible ink volume to the printing mechanism of the printing machine.

The hard phase of the coating material is made preferably of tungsten carbide (Wc), and the metallic binder includes at least one of the elements cobalt (Co) and/or chromium (Cr) and/or nickel, but preferably cobalt and chromium, The weight proportion of the hard phase lies between 75 and 92 percent, preferably between 85 and 90 percent.

The metallic binder represents at least 10 percent of the weight, but preferably 12 to 18 percent.

The thickness of the functional layer is 50 to 200 micrometers, but preferably 80 to 120 micrometers.

According to the method, a metallic adhesion layer is applied preferably prior to the application of the ceramic/carbidic functional layer.

At least one of the elements nickel, chromium or molybdenum is the main constituent of the adhesion layer.

The thickness of the adhesion layer is 50 to 300 micrometers, but preferably 100 to 150 micrometers.

The laser is preferably a pulsed ytterbium fiber laser,

The worn or damaged functional layer and adhesion layer are preferably removed from the cylindrical surface of the anilox roller or anilox sleeve by mechanical machining, and the anilox roller or anilox sleeve is then reconditioned by subsequent new coating and laser processing.

Anilox sleeve or anilox roller for a printing machine, consisting in a fiber-reinforced plastic, the fibers being preferably glass fibers or carbon fibers, on which an intermediate layer is applied, which connects the fiber-reinforced core of the sleeve with an outer enveloping tube out of aluminum or an aluminum alloy.

BRIEF DESCRIPTION OF THE DRAWINGS

The following drawings illustrate an embodiment example of the described method.

PRACTICAL APPLICATION OF THE INVENTION

Figure 1:
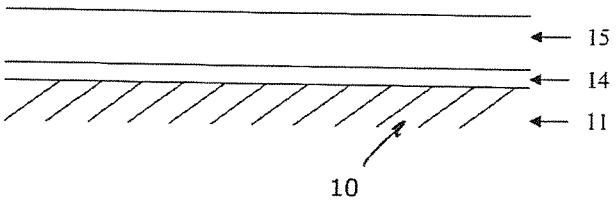
FIG. 1 shows a cross-section of the surface layer of the sleeve according to the invention.
Figure 2:
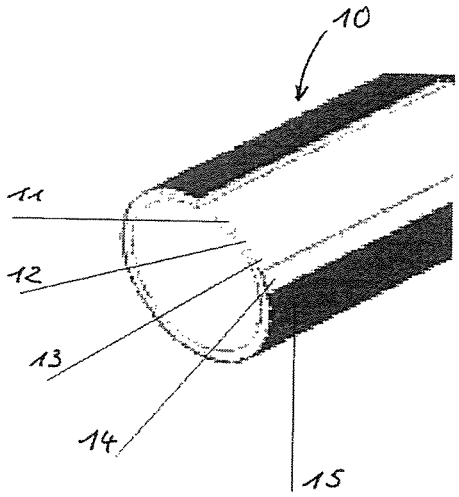
FIG. 2 is a 3D view of the sleeve according to the invention.

Tests have shown that the technical prerequisites are met for applying an engravable WC—Co—Cr coating with the help of a HVOP process on a light anilox sleeve.

For the manufacture or the reconditioning of an anilox sleeve/anilox roller, the surfaces (rollers: steel, sleeves: aluminum) must be suitably prepared (ground or finely turned). Finally, a carbidic WC—Co—Cr layer is applied on the adhesion base by HVOF.

The advantages of this coating, which can be if necessary provided with an adhesion base (HG) in case of particular stress, lie in the changed surface energy of the engraving, which results in improved ink acceptance and transfer. Furthermore, this coating ensures lower wear and improved cleaning behavior of the engraved surface. This moreover allows using less aggressive cleaners, which has a positive impact on the environment and on safety at work. In addition, as the WC—Co layer has a lower porosity, the risk of undercorrosion is practically excluded. This leads overall to significantly lower downtime of the equipment.

As almost all new printing machines used in packaging printing are equipped with anilox sleeves/rollers, the invention thus combines all previously described advantages of the WC—Co—Cr layer with the advantages of the anilox sleeve/roller system:

short setup times, long service life, high quality, high cost-efficiency.

The invention claimed is:

1. A method of either manufacturing or regenerating a functional layer of an anilox sleeve or an anilox roller for a printing machine, the method comprising:

applying a coating of a coating material protecting, against wear and corrosion, by a high-speed flame spraying (HVOF) on a cylindrical surface of the anilox sleeve or the anilox roller, the coating forming the functional layer, manufacturing the coating material from a cermet made of a mixture of a hard phase and a metallic binder, making the hard phase of the coating material from tungsten carbide (Wc), making the metallic binder from at lease one of cobalt (Co), chromium (Cr) and nickel, and structuring a surface topography of the coating by local volatilization of the coating material under the action of an ytterbium fiber laser in such a way that the use of the anilox sleeve or the anilox roller allows supplying a defined reproducible ink volume to the printing mechanism of the printing machine.

2. The method according to claim 1, further comprising making the metallic binder from cobalt (Co) and chromium (Cr).

3. The method according to claim 1, further comprising using a weight proportion of the hard phase between 75 and 92 percent.

4. The method according to claim 1, further comprising using a weight proportion of the hard phase between 85 and 90 percent.

5. The method according to claim 1, further comprising using a weight of the metallic binder which is at least 10 percent.

6. The method according to claim 1, further comprising using a weight of the metallic binder which is between 12 to 18 percent.

7. The method according to claim 1, further comprising using a thickness of the functional layer of between 50 to 200 micrometers.

8. The method according to claim 1, further comprising using a thickness of the functional layer of between 80 to 120 micrometers.

9. The method according to claim 1, further comprising applying a metallic adhesion layer prior to the application of the the coating forming the functional layer.

10. The method according to claim 9, further comprising using at least one of nickel, chromium and molybdenum as a main constituent of the adhesion layer.

11. The method according to claim 9, further comprising using a thickness of the adhesion layer of between 50 to 300 micrometers.

12. The method according to claim 9, further comprising using a thickness of the adhesion layer of between 100 to 150 micrometers.

13. The method according to claim 1, further comprising using a pulsed ytterbium fiber laser as the ytterbium fiber laser.

14. The method according to claim 1, further comprising applying the coating to the anilox sleeve, and making the anilox sleeve from a fiber-reinforced plastic core, the fibers are either glass fibers or carbon fibers, on which an intermediate layer is applied, which connects the fiber-reinforced plastic core of the anilox sleeve with an outer enveloping tube formed out of either aluminum or an aluminum alloy.

15. The method according to claim 1, further comprising removing a worn or a damaged functional layer and adhesion layer from the cylindrical surface of the anilox roller or the anilox sleeve by mechanical machining, and reconditioning the anilox roller or the anilox sleeve by a subsequent new coating and laser processing.

* * * * *